US005083506A

United States Patent [19]

Horn et al.

[11] Patent Number: 5,083,506

[45] Date of Patent: Jan. 28, 1992

[54] CONTINUOUS COMPARTMENTED MIXER

[75] Inventors: Darrell C. Horn, Lafayette; John M. Lennox, III, Sebastopol, both of Calif.

[73] Assignee: Blentech Corporation, Rohnert Park, Calif.

[21] Appl. No.: 665,356

[22] Filed: Mar. 6, 1991

[51] Int. Cl.[5] ..... B01F 7/08; B01F 15/06

[52] U.S. Cl. ..... 99/348; 366/83; 366/97; 366/297

[58] Field of Search ..... 99/348, 483; 366/83, 366/84, 85, 291, 297, 298, 299, 300, 301, 96, 97, 14, 15

[56] References Cited

U.S. PATENT DOCUMENTS

| | | | |
|---|---|---|---|
| 3,176,966 | 4/1965 | Rietz | 366/97 |
| 3,498,754 | 3/1970 | Yamashita | 366/291 |
| 4,733,607 | 3/1988 | Star et al. | 99/348 |
| 4,941,132 | 7/1990 | Horn et al. | 366/278 |
| 4,960,601 | 10/1990 | Cummins | 366/85 |

*Primary Examiner*—Robert W. Jenkins

*Attorney, Agent, or Firm*—Phillips, Moore, Lempio & Finley

[57] ABSTRACT

A continuous mixer having a series of end-to-end mixing compartments each with two parallel shaft-driven agitator ribbons arranged for folding a product into the middle and for end-to-end mixing, as in a batch mixer. As the product is being mixed in each compartment it is gradually and continuously transferred at a controlled rate to the next compartment for further mixing. The completely mixed product in the last compartment is discharged continuously at a rate substantially equal to the rate of transfer between compartments. The mixer has steam jackets for heating each of the compartments so that the mixer may be used for cooking. By adjusting the steam pressure, the amount of heat going into each compartment can be controlled to suit the heating requirements of a variety of products. For example, the compartments may be heated to progressively higher temperatures to prevent burn on.

16 Claims, 5 Drawing Sheets

CONTINUOUS COMPARTMENTED MIXER

This invention relates to the mixing of particulated food products, and more particularly to the mixing and/or cooking of such products on a continuous basis.

BACKGROUND OF THE INVENTION

Mixing, or blending, machines having one or more horizontal agitator shafts positioned in an elongated tub are in common use in the blending of particulated food products such as different mixtures of diced or ground meat, poultry, vegetables, sauces and the like. The most commonly used machine is a twin shaft mixing machine, wherein two horizontal agitator shafts are mounted in a tub parallel to each other. The agitators mounted on the shafts come in many designs, with the most common being a ribbon agitator wherein a spiral ribbon of steel is mounted on each shaft by spokes extending radially from the shafts.

As the agitator shafts rotate, the spiral ribbons push through the product causing it to move in rotating column with the agitator, and, because the ribbons are spiral, to move slowly in a direction parallel to the agitator shafts, i.e. from end-to-end in the tub. Typically, the agitators are rotated in opposite directions so that the rotating columns of the product are moved in opposite end-to-end directions in the tub by the agitators, with the product being continuously folded into the center of the tub and mixed by the counter-rotating agitators.

An example of such a mixing machine is that shown in U.S. Pat. No. 4,733,607, issued Mar. 29, 1988 to Leonard J. Star and Jess J. Tapscott. In this patent, the apparatus also includes a steam jacket surrounding the tub so that the product can be cooked as the agitators mix and blend the product together. Also in the patent, the spiral ribbons have scrapers mounted thereon for scraping the trough walls to keep the product from sticking on the hot cooking surfaces. Ribbon agitator machines used for cold mixing will not have a steam jacket, nor will the scrapers shown in the above patent be required.

Historically, difficult-to-mix products have been mixed on a batch basis in batch operations machines as shown in the above mentioned U.S. Pat. No. 4,733,607. The reason for this is batch systems control all particles of the batch until they evenly mix together. Sticky products such as ground beef products, thick vegetable or fruit slurries do not mix evenly. Pockets of unmixed product remain until very late in the mixing cycle. Two horizontal agitators in a batch mixer have been employed to break up these pockets and evenly distribute all the different ingredients throughout the batch. The horizontal ribbon or paddle agitators fold the ingredients together from one agitator to the other. The length of the mixing cycle is determined by how long it takes to break up the unmixed pockets and evenly distribute all the particles.

Cooking of thick, viscous products is even more difficult. The particles close to the heat exchange surfaces heat up first and must be mechanically pushed away from the heated walls and evenly distributed throughout the batch so that uncooked, cooler particle will come in contact with the heated surfaces of the cooker. If the agitators do not continuously mix the batch during heat-up, some particles will overcook and destroy the flavor of the whole batch.

An additional challenge when cooking some products is that the viscosity of the product will change with temperature. Some products thin out, making it difficult to control the movement of the particles in cold spots in the batch. Some products with starch thicken up with the temperature increase.

All of the above variables have prevented food processing machine designers from seriously considering continuous mixing and cooking of the viscous products. Continuous mixing and cooking, however, is very desirable. Continuous systems are more labor-efficient and the equipment is more cost effective since more production is possible with the same capital outlay. Usually the utility operating costs are less also. Whenever possible, a food processor will install a continuous system over a batch system. Unfortunately, virtually all mixing and cooking of viscous, sticky or variable viscosity products are carried out by batch processing. This means a processor must break out of this continuous flow and batch all mixing elements of his production line and then go back to a continuous flow for packaging. This change in product flow is disruptive and expensive.

Efforts have been made to produce a continuous mixer using the same general concept of two elongated spiral ribbon agitators in an elongated mixing tub. For example, FIGS. 4 and 5 of U.S. Pat. No. 4,941,132, issued July 10, 1990, to Darrell C. Horn and John M. Lennox, III, disclose a continuous mixer having two counter-rotating agitators, oppositely wound on their shafts. Rotation of the shafts in their forward directions will cause the products in each trough of the tub to fold and mix with each other centrally of the tub. At the same time rotation of both shafts in this forward direction will urge the columns of products in both troughs to move together towards the discharge end of the tub. The direction of rotation of the shafts is periodically reversed, with the length of time of reverse rotation being less than the length of time of forward rotation so that the total length of time for the product to be moved incrementally from the inlet end of the tub to the discharge end of the tub to the discharge end of the tub can be regulated. The ingredients of the product are continuously fed into the inlet end of the tub and continuously removed from the discharge end.

Such a continuous mixer can, however, only be used with ingredients that are easy to mix, which do not flow and which do not require the end-to-end mixing of columns moving in opposite directions (i.e. as in batch mixers).

SUMMARY OF THE INVENTION

It is an object of the invention to overcome the disadvantages described above and provide a mixing method and apparatus which will have the mixing efficiency of a batch mixer while at the same time enabling the ingredients of the product to be added continuously and the fully mixed product to be discharged continuously.

In the broadest aspect of the invention a continuous mixer is provided, the mixer having an elongated tub with at least two end-to-end compartments, each compartment having two elongated rotatable agitators therein arranged for batch mixing within the compartment, means for continuously transferring a portion of the product in the first of two adjacent compartments to the next at a controlled rate of transfer, and means for continuously discharging a portion of the product in the last compartment from that compartment at a controlled rate substantially the same as the rate of transfer from one adjacent compartment to the next.

A further aspect of the invention is that at least one screw is provided to transfer the product from one adjacent compartment to the next, the screw being rotatable with one of the agitators so that transfer is made during the batch mixing in the compartments.

A still further aspect of the invention is that the rate of rotation of the agitators and screw is chosen for optimal mixing and that the direction of rotation of the agitators and screw are repeatedly reversed for better mixing and at a ratio of forward to reverse rotation to product incremental transfer of the product at an optimal rate from one compartment to the next.

Yet another aspect of the invention is that the compartments are separately heated so that they may be kept at different temperatures for optimal even cooking of a product.

Other aspects of the invention will become apparent in the course of the following detailed description.

BRIEF DESCRIPTION OF THE DRAWINGS

In the drawings, forming a part of this application, and in which like parts are designated by like reference numerals throughout the same.

DESCRIPTION OF THE PREFERRED EMBODIMENTS

Figure 1:
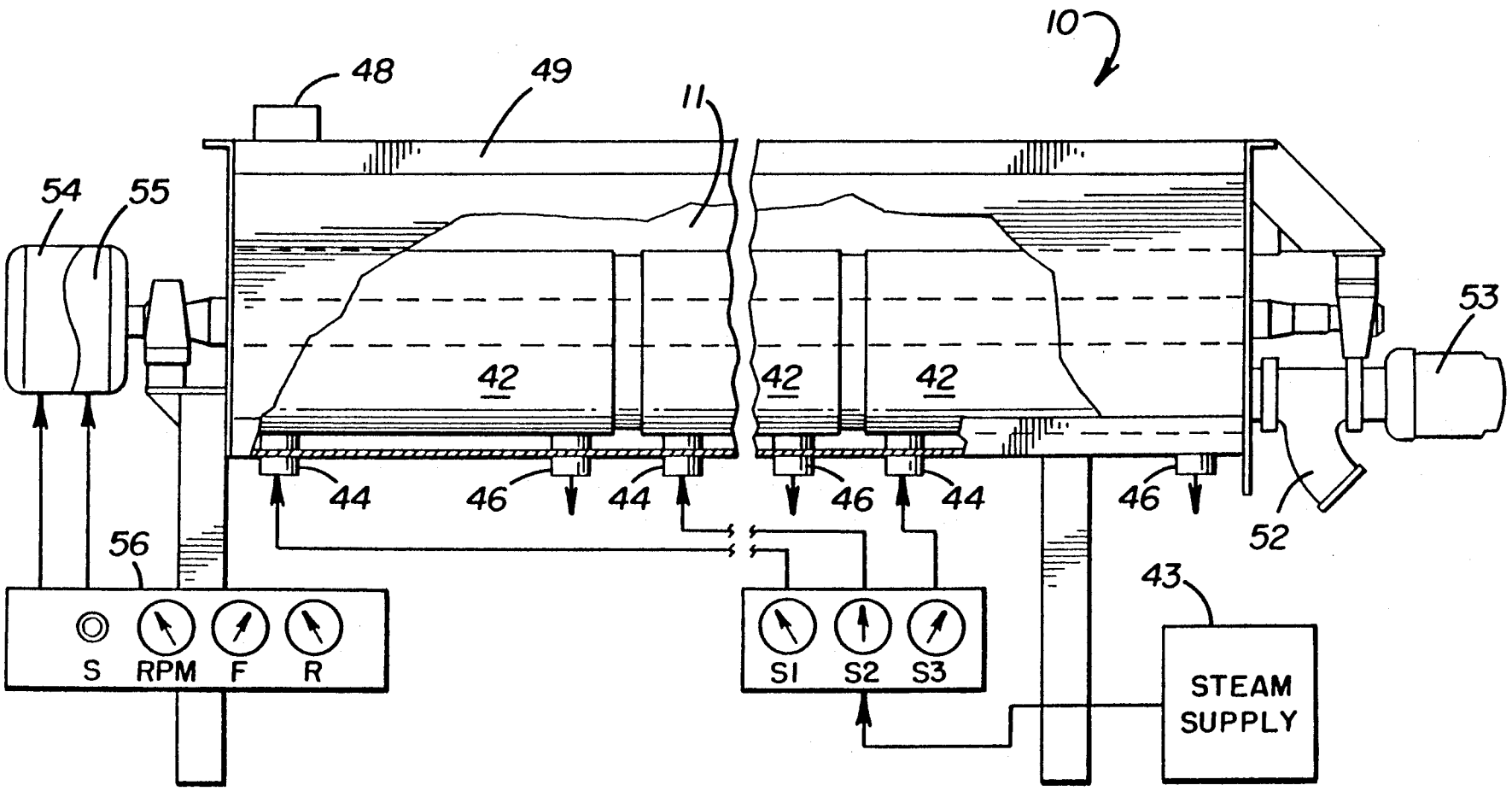
FIG. 1 is a side elevational view of a twin shaft agitator continuous mixer, constructed in accordance with the present invention, and with portions cut away.
Figure 2:
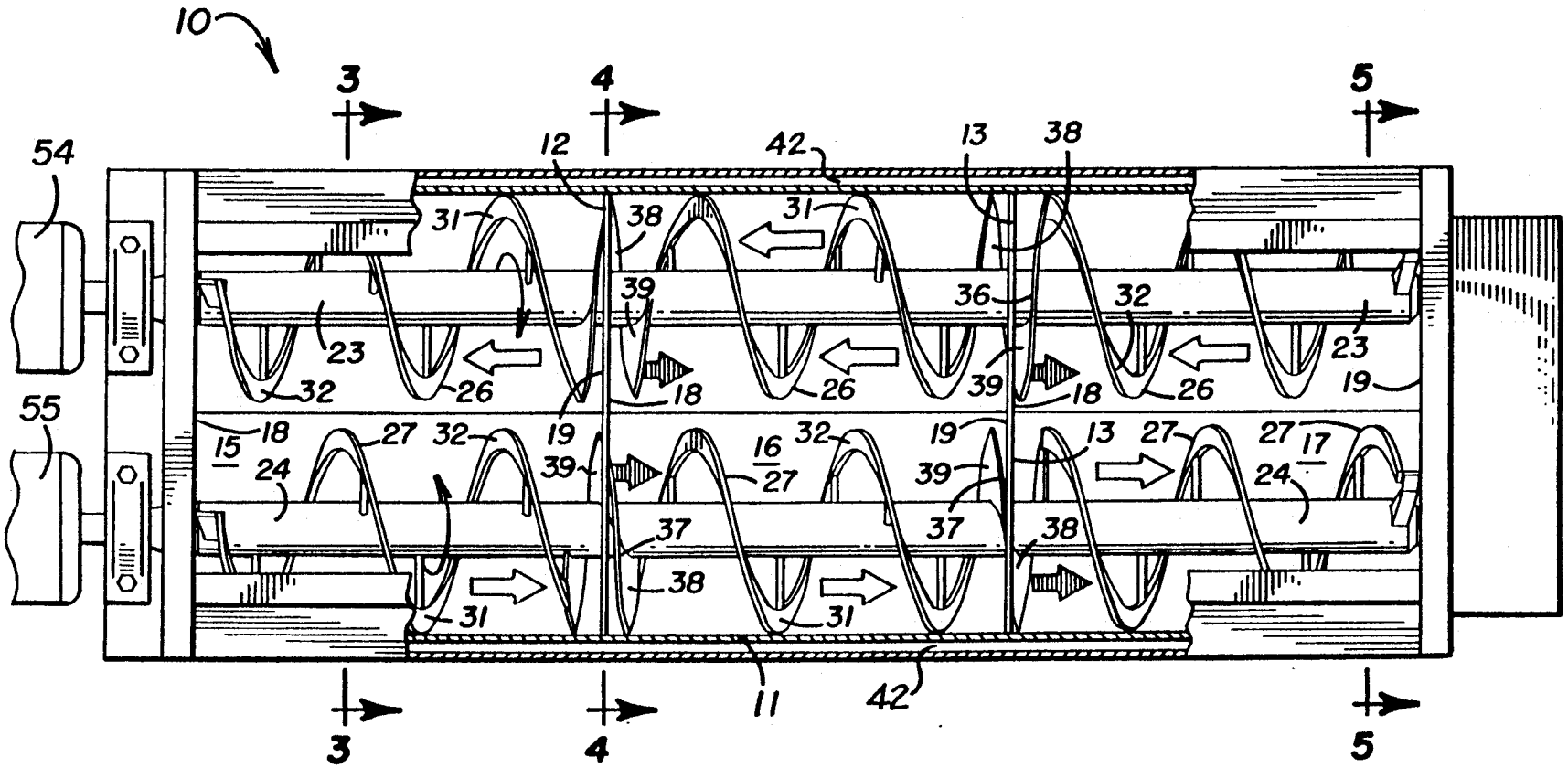
FIG. 2 is a view, in plan, and with portions cut away, of the mixer of FIG. 1.
Figure 3:
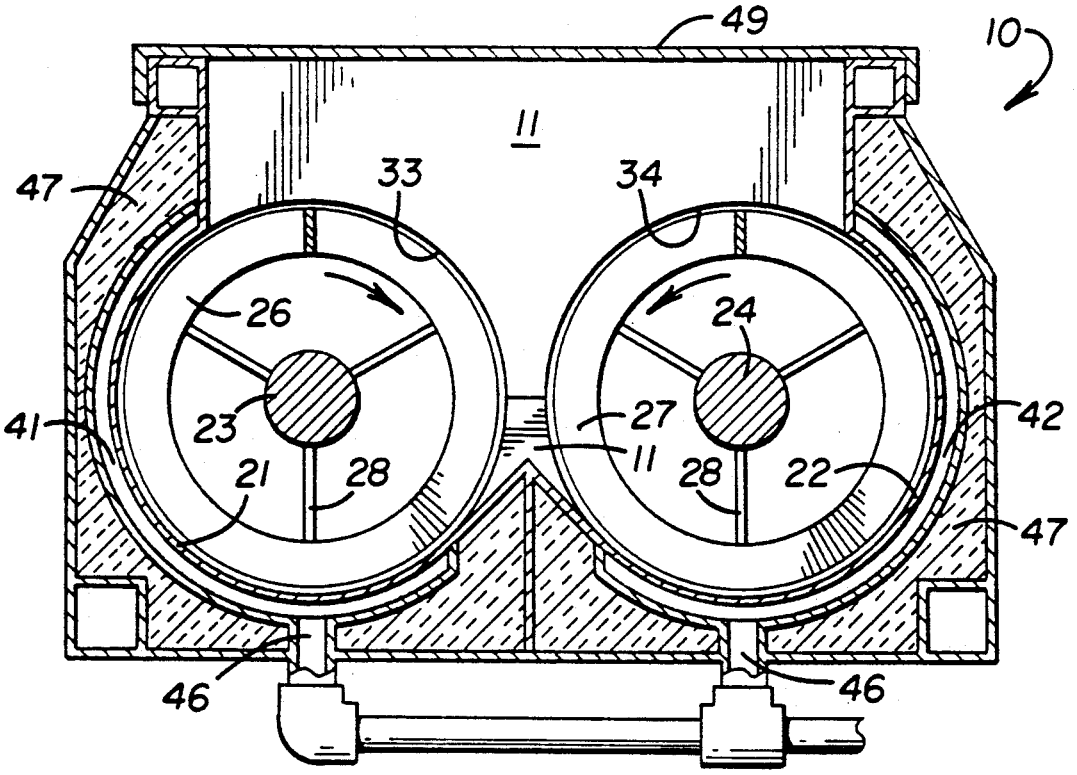
FIGS. 3, 4 and 5 are elevational sectional view of the mixer of FIG. 1, taken on line 3—3, 4—4 and 5—5 of FIG. 2.
Figure 4:
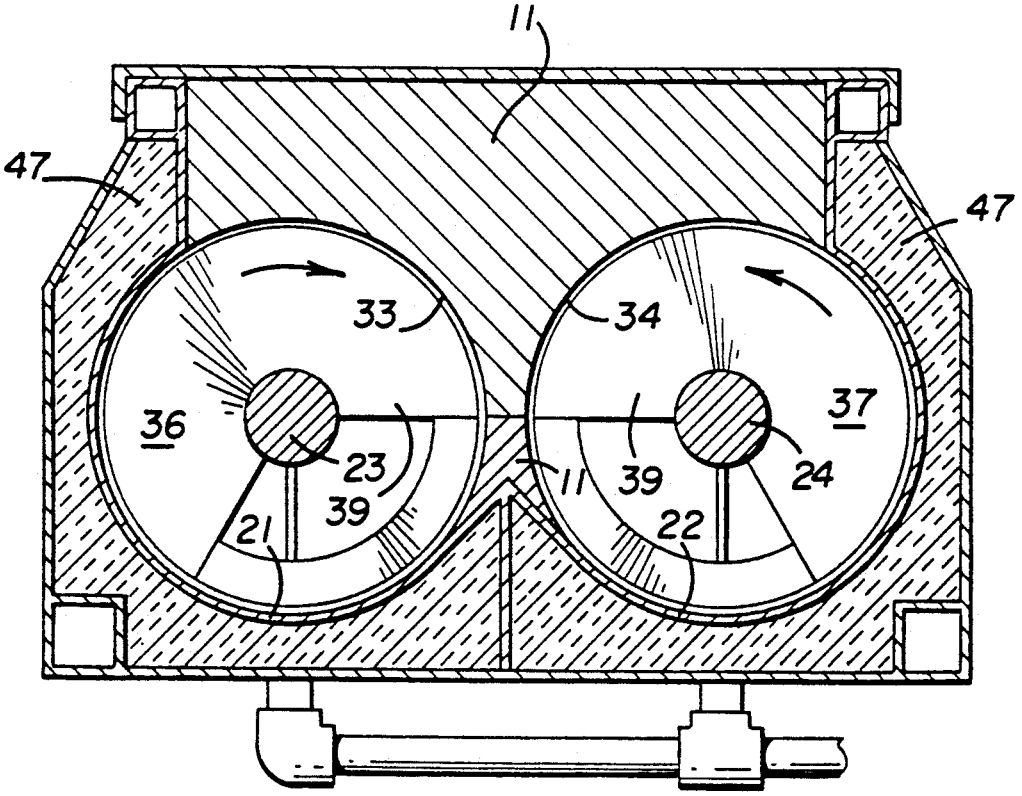
Figure 5:
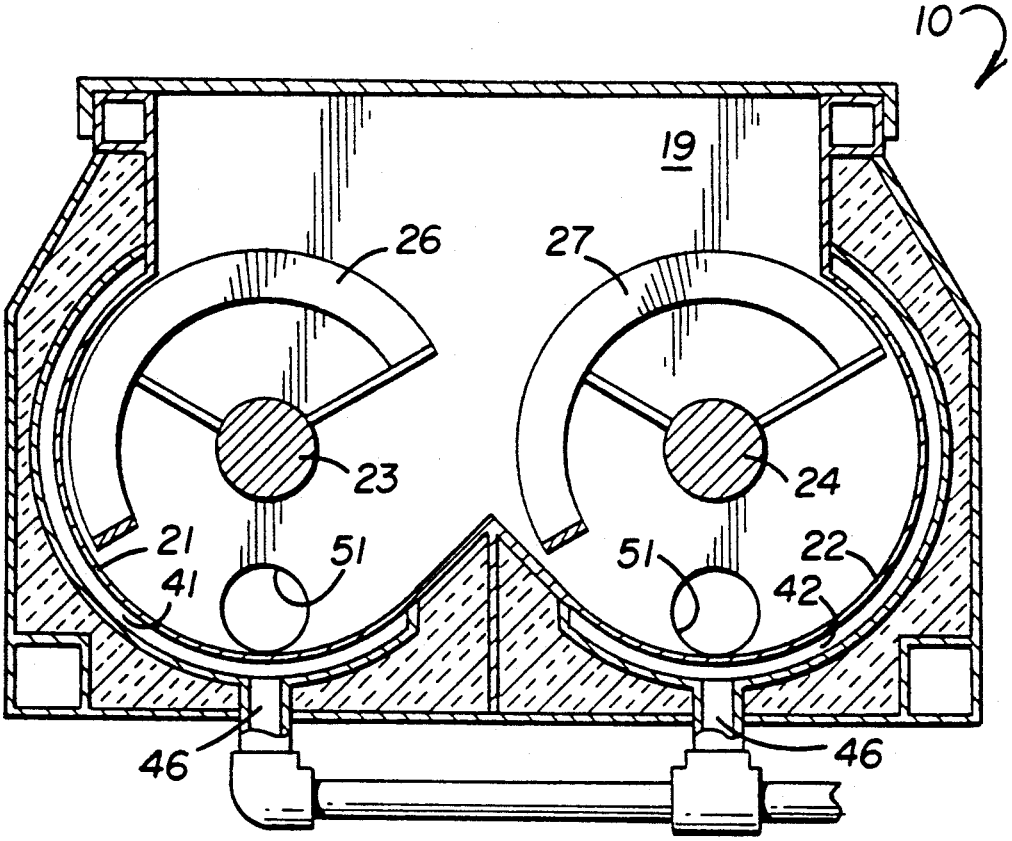
Figure 6:
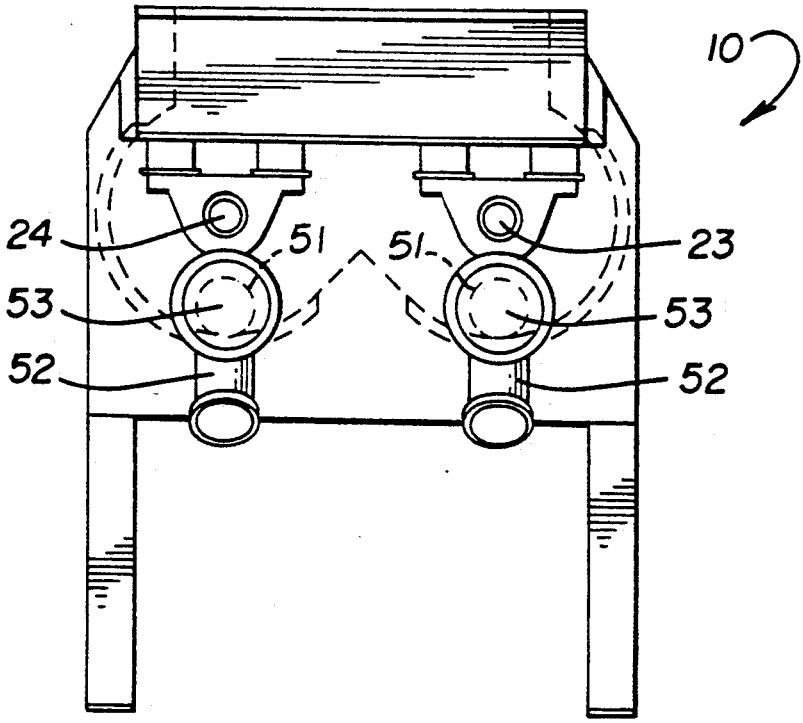
FIG. 6 is an elevational view of the discharge end of the mixer of FIG. 1.

Referring now to the drawings, wherein preferred embodiments of the inventions are shown, and in particular to the embodiment of FIGS. 1–6, the mixer 10 comprises a tub 11 having transverse vertical partitions 12 and 13 to divide the tub into a plurality of end-to-end compartments 15, 16 and 17, each compartment having a first end 18 and a second, or discharge, end 19 and side-by-side arcuate troughs 21 and 22 extending between the opposed ends 18 and 19. Two horizontal shafts 23 and 24 extend lengthwise of the tub, the shafts being centered in the arcuate troughs 21 and 22. Two horizontal and parallel spiral agitator ribbons 26 and 27 are disposed in each compartment, the ribbons being mounted on shafts 23 and 24 by spokes 28. As seen in FIG. 3, the outer radii of the agitator ribbons are slightly less than the radii of the troughs 21 and 22.

The spiral agitator ribbons 26 and 27 are both wound on their shafts 23 and 24 in the same direction, and each ribbon has spiral surfaces 31 and 32 thereon each facing towards opposite ends of the compartment. When shafts 23 and 24 are rotated in opposite directions, and in a "forward" direction, as indicated by the direction arrows in FIGS. 2–4, the surfaces 31 on agitator ribbons 26 and 27 will urge products in contact therewith to move towards the first and second ends 18 and 19, respectively, of the compartment, i.e. in the directions as indicated by the unshaded flow arrows of FIG. 2. Rotation of the agitator ribbons in an opposite "reverse" direction will cause surfaces 32 of the agitator ribbons to urge the product to move in the opposite directions lengthwise of the compartment.

The partitions 12 and 13, through which shafts 23 and 24 extend have openings therethrough of a diameter to allow clsoe-pitch solid screws 36 and 37 to rotate therein. Screws 36 and 37 are mounted on shafts 23 and 24, respectively, for rotation therewith, and extend in both directions from the partitions in which they rotate. As shown in FIG. 2, the screw 36 is left-handed, i.e. opposite to the direction in which agitator ribbon 26 is wound on shaft 23, whereas the screw 37 on shaft 24 is wound in the same right-hand direction as the agitator ribbons 27 on that shaft. With this arrangement, the surfaces 38 on both screws 36 and 37 will move a product in contact therewith to move from one compartment to the next in direction as indicated by the shaded flow arrows upon forward rotation of both shafts 23 and 24.

Steam jackets 41 and 42 surround troughs 21 and 22, respectively, in each compartment 15, 16 and 17 of mixer 10. Steam from a steam supply 43 can be supplied separately to the steam jackets for each compartment through pressure and/or flow regulator valves separately adjusted by controls 51, 52 and 53 to the inlets 44 at one end of each compartment's steam jackets. Steam and condensate will discharge from outlets 46 at the other end of the steam jackets. Each of the steam jackets will have conventional internal baffling (not shown) to provide proper distribution of the steam flowing through the jackets for even heating of the troughs 21 and 22. Suitable thermal insulation 47 surrounds the steam jackets.

A feed chute 48 is provided on the top cover 49 for feeding the ingredients of the products to be mixed into the first mixing compartment 15. The discharge end wall 19 of the last mixing compartment 27 has openings 51 leading to discharge conduits 52 in which the flows are adjustably regulated by conventional variable-speed positive-displacement pumps 53 to control the rate of discharge of a product from compartment 15.

The agitator shafts 23 and 24 are rotated by reversible motors 54 and 55. A control box 56 is electrically connected to the motors, and typically will have a start-stop button S, a speed control RPM to adjust the rate of rotation of the agitator shafts 23 and 24, and timers F and R to control the length of forward rotation and reverse rotation in a cycle of operation.

In operation, the first compartment 15 is filled with the various ingredients of the product to be mixed and the agitators are rotated in repeated cycles of forward then reverse rotation. During the forward direction of each cycle the agitator 26 will urge the column of ingredients in trough 21 to move towards end wall 18 while the agitator 27 will urge the column of ingredients in trough 22 to move towards end wall 19. The countermoving columns of product and the folding of ingredients to the center of the tub by the counterrotating agitators causes the ingredients of the product to mix well with each other. During the reverse direction portion of each cycle, the columns of ingredients will move in the opposite direction, but the same mixing action will occur. The reverse action of the agitators also helps to prevent accumulation of unmixed ingredients in the corners of the compartment.

With product in the first compartment, a forward rotation of the two shafts 23 and 24 will cause both screws 36 and 37 to move a portion of the product in the compartment 15 to the next compartment 16. In due time, compartment 16 will fill, the screws 36 and 37 at the discharge end of compartment 16 will transfer product into compartment 17 and that compartment will fill.

In continued operation, each mixing compartment will act as a batch mixer, with countermoving columns of products folding into each other at the center of the compartment. At the same time, a portion of the product in compartment 15 will be transferred continuously to the inlet end of compartment 16 while a corresponding portion of the product in that compartment is discharged continuously and transferred into compartment 17. A corresponding amount of the product is then discharged continuously from the valved outlets 52 of compartment 27. Batches of the ingredients, in separate containers and in the desired ratio of the final product, are continuously added by feed chute 48 to compartment 15 at substantially the same rate as the rate of transfer from one adjacent compartment to the next and as the rate of discharge from the last compartment.

The operation thus provides a partial mixing in the first compartment, a metered flow of the partially mixed product into the next compartment where further mixing takes place, a metered flow of that product into the last compartment for further mixing. By the time that the product is discharged, it is completely mixed.

The above described apparatus has an important aspect in that the rate of rotation of the agitator and rate of transfer from one compartment to the next can be separately adjusted. The speed of rotation of the agitators determines how aggressively the product is mixed within each compartment. Some products can be mixed more aggressively than others. In operation, the RPM control will be se to provide the most efficient agitator speed for the particular product being mixed.

In operation, product will be transferred from compartment 15 to compartment 16 during the time the screws 36 and 37 are rotated in a forward direction. When the screws are rotated in the opposite direction, their surfaces 39 will move the product in the reverse direction, i.e back towards compartment 15. To effect forward transfer in a cycle of operation, the ratio to forward rotation to reverse rotation must be greater than one. The greater the ratio, the product will be transferred for each cycle of reversing operation.

Thus, with the speed of agitator rotation set for maximum mixing efficiency, the times of forward and reverse rotation are set to produce a desired rate of forward transfer between compartments without changing the speed of agitator rotation.

The mixer 10 can be used as described above for the unheated mixing of ingredients. In such case, no steam would be flowed through the steam jackets. If it is desired to operate the mixer as a cooker, then the steam jackets 41 and 42 would be used. As mentioned previously, the controls 51, 52 and 53 will enable the heat going into each compartment to be separately controlled. For example, the controls can be adjusted so that the troughs 21 and 22 of the compartments 15, 16 and 17 are at progressively higher temperatures to reduce the potential for "burn on" (burning of product on the trough walls). The rate of heat transfer from the trough walls to the product in contact with the wall increases with the difference in temperature between a trough wall and the product in contact therewith, and the potential for burn on increases with an increase in the rate of heat transfer. Thus, with a relatively cool product the first compartment, a relatively low heating temperature will decrease the possibility of burn on. In the next compartment the average temperature of the product will be higher and the heating temperature can likewise be higher without unduly increasing the difference in temperature between the trough walls and the product. In the last compartment, the preheated product will be brought to final temperature.

In operation of mixer 10 as a cooker, reversible scrapers would be added to the agitator ribbons to scrape the trough walls to prevent adherence of product to the heated walls. The use of such scrapers in a cooker is well known, and scrapers such as those shown in the previously referred to U.S. Pat. No. 4,733,607 (the disclosure of which is incorporated herein by reference) may be used for this purpose.

Although the embodiments described herein show three end-to-end compartments, four or more compartments might be used if it is desired to have a lesser degree of mixing in each compartment. Also, a mixer having only two compartments might be used for products which could be both fully mixed in two compartments and transferred at a suitable rate from the first compartment to the next so that efficient continuous mixing could be obtained.

Other apparatus can be used to control the transfer from compartment to compartment, such as adjustable gates or doors on the partitions between compartments. For example, in the embodiment of the invention shown in FIGS. 7 and 8, the mixer 110, having shafts 123 and 124 with agitator ribbons 126 and 127 wound thereon for rotation in the arcuate troughs 121 and 122, has openings 133 and 134 through the partition 112, separating compartments 115 and 116. Shutter valves 136 and 137 are disposed in compartment 115 adjacent the openings 133 and 134 to adjust the area of the openings through which product flow may take place. The shutter valves 136 and 137 are journaled on shafts 123 and 124 and are provided with extensions 138 which project through ball joints 139 that are threaded onto jack screws 141. Rotation of the cranks 142 can thus move the shutter valves to a desired position between closed or open, such positions being shown by the positions Of the shutters 136 and 137 in FIG. 8.

Figure 7:
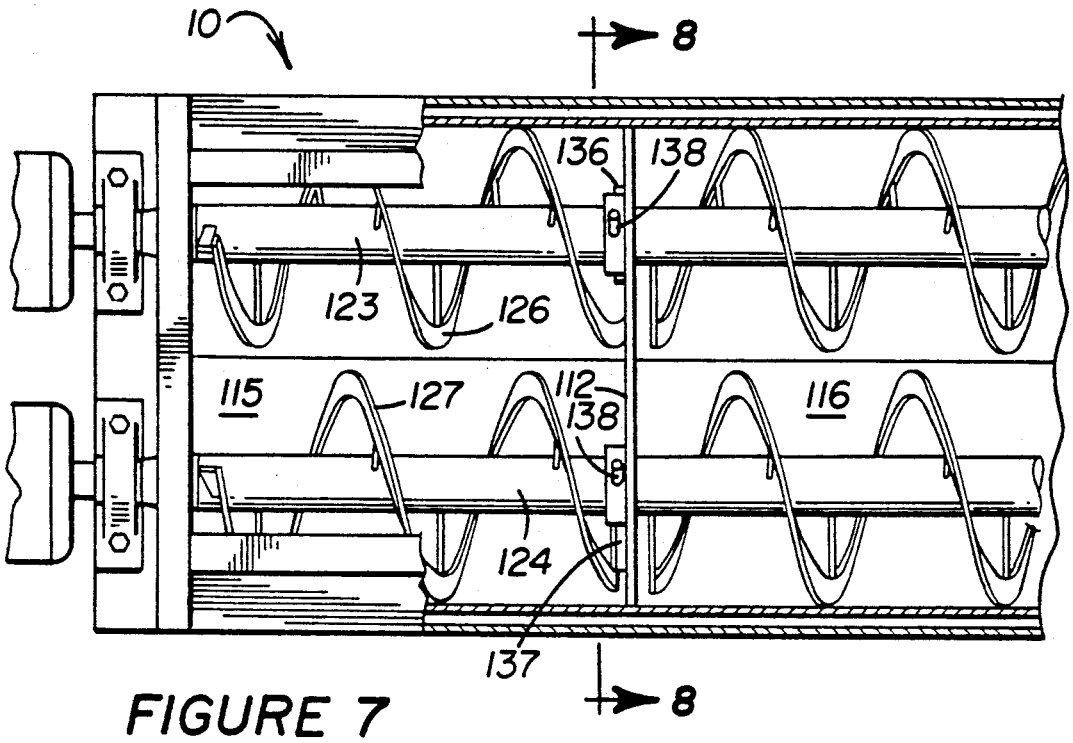
FIG. 7 is a view similar to FIG. 2, illustrating another embodiment of the invention.
Figure 8:
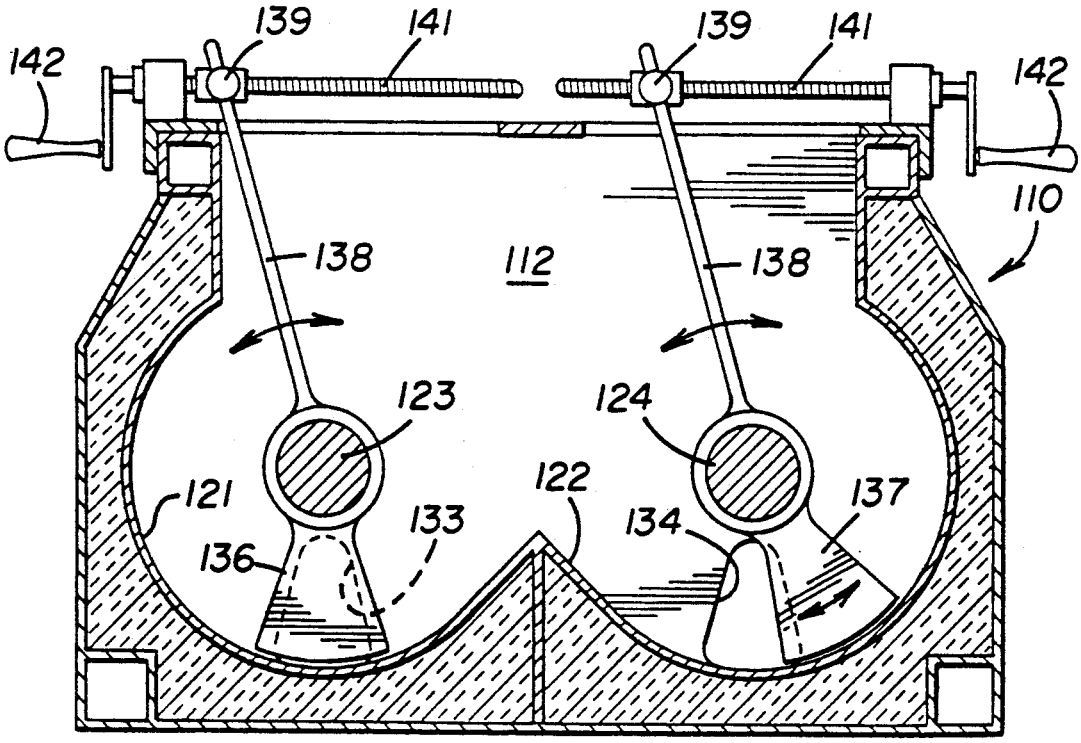
FIG. 8 is an elevational sectional view taken on line 8—8 of FIG. 7.

The embodiment of FIGS. 7 and 8 is particularly adapted to the mixing and/or cooking of products that flow easily. In this embodiment the level of the product in each successive compartment will be at a progressively lower level, so that the difference in head pressure will cuase the product to flow through the openings 133 and 134 from the higher level compartment to the next, and lower level, compartment. The discharge valves at the last compartment and the shutter valves 136, 137 between adjacent compartments are adjusted so that the level of product in successive compartments is maintained at desired levels.

In the embodiments of the invention, the rate of transfer flow must be adjustable to match the flow through all of the compartments of the mixer with the time it takes to mix and/or cook the product, since the total residence time in the mixer should be no more than is required for proper mixing and/or cooking the product.

The foregoing description of the preferred embodiments has been presented for purposes of illustration description. It is not intended to be exhaustive or to limit the invention to the precise forms described, and obviously many other modification are possible in light of the above teaching. The embodiments were chosen in order to explain most clearly the principles of invention and its practical applications thereby to enable others in the art to utilize most effectively the invention in various other embodiments and with various other modifications as may be suited to the particular use contemplated. It is intended that the scope of the invention be defined by the claims appended thereto.

We claim:

1. A continuous mixer comprising:

an elongated tub having at least two end-to-end compartments, each compartment having first and second opposed ends and two side-by-side arcuate troughs extending between said ends, a pair of elongated agitators mounted in each compartment for rotation about horizontal axes, one in each of said arcuate troughs, one agitator in a compartment having means thereon for urging a product in contact therewith to move towards the second end of the compartment when it is rotated in a forward direction, the other agitator in the compartment having means thereon for urging a product in contact therewith to move towards the first end of the compartment when it is rotated in a forward direction, means for rotating said agitators in unison in their forward directions, means for continuously transferring a portion of a product in the first of two adjacent compartments from that compartment into the next of said compartments at a controlled rate of transfer, means for continuously discharging a portion of that product in the last of said compartments from the compartment at a controlled rate substantially the same as said rate of transfer.

2. A mixer as set forth in claim 1 and further including:

at least one heater for each compartment of said tub, means for supplying heat to said heaters to heat said compartments to individual predetermined levels.

3. A mixer as set forth in claim 1, wherein adjacent compartments have a generally vertical partition therebetween, and wherein said means for transferring from the first to the next of two adjacent compartments comprises a solid screw rotatable in unison with at least one of said agitators in said first compartment, said partition having an opening of a diameter to allow said screw to rotate therein, said screw extending in both directions from said partition, said screw having a surface thereon for moving a product in contact therewith from said first to said next of said adjacent compartments in response to forward rotation of the agitator with which said screw rotates.

4. A mixer as set forth in claim 1, wherein adjacent compartments have a generally vertical partition therebetween, and wherein said means for transferring from the first to the next of two adjacent compartments comprises a solid screw rotatable in unison with each of the agitators in said first compartment, said partition having openings each of a diameter to allow said screw to rotate therein, said screws extending in both directions from said partition, said screws each having a surface thereon for moving a product in contact therewith from said first to said next of said adjacent compartments in response to forward rotation of both of said agitators.

5. A mixer as set forth in claim 1, wherein adjacent compartments have a generally vertical partition through which said shafts extend, and wherein said means for transferring from the first to the next of two adjacent compartments includes an opening through said partition from one of said compartments to the other and means for adjusting the size of said opening.

6. A continuous mixer comprising:

an elongated tub having at least two end-to-end compartments, each compartment having first and second opposed ends and two side-by-side arcuate troughs ending between said ends, a pair of rotatable horizontal shafts extending through said compartments, an elongated agitator mounted on each shaft in each compartment for rotation in said arcuate troughs upon rotation of said shafts, one agitator in a compartment having means thereon for urging a product in contact therewith to move towards the second end of the compartment when the shaft on which it is mounted is rotated in a forward direction and to move towards the first end of the compartment when the shaft is rotated in a reverse direction, the other agitator in the compartment having means thereon for urging a product in contact therewith to move towards the first end of the compartment when the shaft on which it is mounted is rotated in a forward direction and to move towards the second end of the compartment when its shaft is rotated in a reverse direction, means for cyclically rotating said shafts in unison first in their forward directions and then in their reverse directions and for setting the ratio of forward and reverse rotation times in a cycle of operation, means for continuously transferring a portion product in the first of two adjacent compartments from that compartment into the next of said compartments at a controlled rate of transfer, means for continuously discharging a portion of a product in the last of said compartments from that compartment at a controlled rate substantially the same as said rate of transfer.

7. A mixer as set forth in claim 6, and further including:

at least one heater for each compartment of said tub, means for supplying heat to said heaters to heat said compartments to individual predetermined levels.

8. A mixer as set forth in claim 6, wherein adjacent compartments have a generally vertical partition therebetween through which said shafts extend, and wherein said means for transferring from the first to the next of two adjacent compartments comprises a solid screw on at least one of said shafts, said partition having an opening of a diameter to allow said screw to rotate therein, said screw extending along said one shaft in both directions from said partition, said screw having surfaces thereon for moving a product in contact therewith from said first to said next of said adjacent compartments, or vice versa, in response to forward or reverse rotation, respectively, of said one shaft.

9. A mixer as set forth in claim 6, wherein adjacent compartments have a generally vertical partition therebetween through which said shafts extend, and wherein said means for transferring from the first to the next of two adjacent compartments comprises a solid screw on each of said shafts, said partition having openings of a diameter to allow said screws to rotate therein, said screws extending along said shafts in both directions from said partition, each of said screws having surfaces thereon for moving a product in contact therewith from said first to said next of said adjacent compartments, or vice versa, in response to forward or reverse rotation, respectively of the shaft upon which the screw is mounted.

10. A mixer as set forth in claim 9 and further including:

at least one heater for each compartment of said tub, means for supplying heat to said heaters to heat said compartments to individual predetermined levels.

11. A mixer as set forth in claim 6 wherein adjacent compartments have a generally vertical partition through which said shafts extend, and wherein said means for transferring from the first to the next of two adjacent compartments includes an opening through said partition from one of said compartments to the other and means for adjusting the size of said opening.

12. A mixer as set forth in claim 11 and further including:

at least one heater for each compartment of said tub, means for supplying heat to said heaters to heat said compartments to individual predetermined levels.

13. A method of mixing a product in a mixer tub having first and second end-to-end compartments, said compartments each having first and second opposed ends, said compartments having a generally vertical partition therebetween which is the second end of said first compartment and the first end of said second compartment, a pair elongated agitators disposed in each compartment for rotation about parallel horizontal axes extending between the ends of the compartment, one of each pair of agitators having means thereon for urging a product in contact therewith to move towards said second end or the first end of its compartment in response to forward or reverse rotation, respectively, thereof, and the other agitator of the pair having means thereon for urging a product in contact therewith to move towards said first end or said second end of the compartment in response to forward or reverse rotation, respectively, thereof, said partition having two openings therethrough, a solid screw rotatable in unison with each of said agitators, said screws extending through said openings, said screws each having surfaces thereon for urging a product in contact therewith to move from said first compartment to said second compartment, or vice versa, in response to forward or reverse rotation, respectively, of the agitator with which the screw rotates, said method comprising:

repeatedly reversing the rotation of the pair of agitators in each compartment so that for each repeated cycle of operation both agitators rotate in unison in their forward direction for a predetermined length of time and then rotate in unison in their reverse directions for a predetermined length of time, setting the speed of rotation of said agitators to produce optimal mixing of the particular product in said mixer, setting the ratio of the length of times of forward and reverse rotations of said agitators so that said screws transfer product from the first to the second compartment at a desired rate.

14. A method of mixing as set forth in claim 13, wherein said compartments each have separate heaters therefor, the method further comprising:

heating said first compartment to a desired level, heating said second compartment to a desired and higher level.

15. A method of mixing as set forth in claim 13, and further including:

feeding ingredients of the product into said first compartment at a rate substantially equal to the rate of transfer of product from said first to said second compartment, discharging a portion of the product in said second compartment from said compartment at a rate substantially equal to said rate of transfer of product from said first to said second compartment.

16. A method of mixing as set forth in claim 15, wherein said compartments each have separate heaters therefor, the method further comprising:

heating said first compartment to a desired level, heating said second compartment to a desired and higher level.

* * * * *